US007490659B2

(12) United States Patent
Kwon et al.

(10) Patent No.: US 7,490,659 B2
(45) Date of Patent: Feb. 17, 2009

(54) INTEGRAL-TYPE HEAT EXCHANGER

(75) Inventors: Daebok Kwon, Daejeon-si (KR); Hongyoung Lim, Daejeon-si (KR)

(73) Assignee: Halla Climate Control Corporation, Daejeon-Si (KR)

( * ) Notice: Subject to any disclaimer, the term of this patent is extended or adjusted under 35 U.S.C. 154(b) by 0 days.

(21) Appl. No.: 11/703,568

(22) Filed: Feb. 7, 2007

(65) Prior Publication Data

US 2007/0187077 A1 Aug. 16, 2007

(30) Foreign Application Priority Data

Feb. 13, 2006 (KR) ..... 10-2006-0013733

(51) Int. Cl.
*F28D 7/16* (2006.01)
*F28D 1/053* (2006.01)

(52) U.S. Cl. ..... 165/140; 165/149

(58) Field of Classification Search ..... 165/135, 165/140
See application file for complete search history.

(56) References Cited

U.S. PATENT DOCUMENTS

| | | | | |
|---|---|---|---|---|
| 2,037,845 | A * | 4/1936 | Young | 165/139 |
| 5,445,219 | A * | 8/1995 | Hutto et al. | 165/173 |
| 6,394,176 | B1 * | 5/2002 | Marsais | 165/140 |
| 6,883,600 | B2 * | 4/2005 | Mano et al. | 165/174 |
| 7,051,795 | B2 * | 5/2006 | Kamiyama et al. | 165/140 |
| 7,284,594 | B2 * | 10/2007 | Sanada et al. | 165/41 |
| 2002/0040776 | A1 * | 4/2002 | Kokubunji et al. | 165/140 |
| 2005/0217831 | A1 * | 10/2005 | Manaka | 165/140 |
| 2005/0217832 | A1 * | 10/2005 | Sanada et al. | 165/140 |
| 2005/0257921 | A1 * | 11/2005 | Hu | 165/140 |
| 2006/0113068 | A1 * | 6/2006 | Desai et al. | 165/140 |
| 2006/0207755 | A1 * | 9/2006 | Kalbacher | 165/140 |

FOREIGN PATENT DOCUMENTS

JP 2005-069600 3/2005

* cited by examiner

*Primary Examiner*—Allen J Flanigan
(74) *Attorney, Agent, or Firm*—Fulbright & Jaworski L.L.

(57) ABSTRACT

The present invention relates to an integral-type heat exchanger with integrally formed heat exchange portions, in which the heat transfer between heat exchange portions is effectively intercepted, a core portion without a tank is respectively formed to improve the productivity, and the tank is used in common.

5 Claims, 4 Drawing Sheets

Prior Art

INTEGRAL-TYPE HEAT EXCHANGER

BACKGROUND OF THE INVENTION

1. Field of the Invention

This application claims priority from Korean Patent Application No. 10-2006-0013733 filed Feb. 13, 2006, incorporated herein by reference in its entirety.

The invention relates to an integral-type heat exchanger, and more particularly, to an integral-type heat exchanger in which two heat exchange portions are integrally formed with each other.

2. Background of the Related Art

In general, vehicles with an internal combustion engine have been widely used and mass-produced by combusting fossil fuel as power source to thereby generate power. However, with regard to the vehicles with internal combustion engine, there were caused problems of harmful exhaust gas produced from the combustion of the fuel and exhaustion of the fossil fuel, and the like, so that nowadays it is a trend that vehicles using substitute energy have been rapidly developed.

Nowadays, vehicles using the solar energy and the battery charged with electric power as power source have been come true. The electric vehicle is constructed to operate by the driving of a motor activated by the electric power of the battery.

However, since the electric vehicle takes much time in charging the battery, and the amount of the electric power to be charged is restricted, a hybrid vehicle using the internal combustion engine and the battery as composite power source has been developed.

The hybrid vehicle is also provided with several heat exchangers for heating and cooling indoors of the vehicle and for cooling the engine.

Meanwhile, since the fluids to be cooled by the heat exchanger are diversified, various types of integral-type heat exchangers have been developed to perform the function of heat exchange of several fluids by integrating several heat exchangers into a sole heat exchanger.

In Japanese Patent Laid-Open Publication No. 2005-69600 entitled "A compound heat exchanger", there is disclosed an integral-type heat exchanger applied to the hybrid vehicle, in which a radiator for cooling the heat generated from the engine in the heat exchanger is integrally formed with a heat exchanger for cooling an inverter circuit for driving a motor.

FIG. 1 is a view for showing an integral-type heat exchanger according to conventional art (hereinafter, the complexity of the explanation is prevented by referring only a portion related to the present invention).

As shown in the drawing, the integral-type heat exchanger comprises a plurality of first tubes 1 through which engine cooling water is circulated, a plurality of second tubes 2 through which inverter cooling water is circulated for cooling an electrically-driven motor (not shown) for the driving and an inverter circuit for driving the motor, a header and a tank 3 disposed at both longitudinal ends of the first and second tubes 1, 2 so that they fluidically communicate with each other, a separator 4 for dividing a space of the header and tank 3 into a first space a fluidically communicating with the first tube 1 and a second space b fluidically communicating with the second tube 2, and the like.

Also, a first inlet pipe 5 and a first outlet pipe 6 are disposed at the first space a, and a second inlet pipe 7 and a second outlet pipe 8 are disposed at the second space b.

In the conventional compound heat exchanger as constructed above, the engine cooling water is circulated through the first inlet pipe 5, the first tube 1, the first outlet pipe 6, and the header tank 3 constituting the first space a, and the inverter cooling water is circulated through the second inlet pipe 7, the second tube 2, the second outlet pipe 8, and the header tank 3 constituting the second space b, to thereby perform the cooling of the engine and the driving motor.

However, in the conventional integral-type heat exchanger as described above, there was a problem that heat transfer between the engine cooling water and the inverter cooling water is not effectively blocked in the heat exchange process because the header and tank 3 fluidically communicating with the first tube 1 and the second tube 2 is integrally formed.

In other words, although a dummy tube 9 and the like are disposed at the boundary of the first tube 1 and the second tube 2, the temperature of the cooling water circulating through them is different, since the header and the tank 3 are formed integrally with each other, the heat transfer cannot be effectively intercepted.

Meanwhile, with regard to the conventional integral-type heat exchanger, since the objects of the respective heat exchange fluid is different, the size and standard of the fin or tube, which is an indispensable parts of the heat exchanger, should be differed at most, so that it was difficult to construct two heat exchangers at the same time in view of the manufacturing process, and difficulty was accompanied in administrating the automatic establishments.

Also, when any one of the integral-type heat exchanger is disordered, the entire heat exchanger should be disposed.

SUMMARY OF THE INVENTION

Therefore, the present invention has been made in an effort to solve the above problems occurring in the prior art, and an object of the present invention is to provide an integral-type heat exchanger, in which two heat exchange portions are formed integrally with each other, the heat transfer between heat exchange portions is effectively intercepted, a core portion without a tank is respectively formed to improve the productivity and the tank is used in common.

To accomplish the above objects, according to the present invention, there is provided an integral-type heat exchanger comprising a first core portion including a plurality of first tubes through which first fluid flows, first radiation fins interposed between the first tubes, and first headers, each of which is engaged with both ends of the first tubes, a second core portion including a plurality of second tubes through which second fluid flows, second radiation fins interposed between the second tubes, and second headers, each of which is engaged with both ends of the second tubes, a single tank engaged concurrently with the first header of the first core portion and the second header of the second core portion disposed at upper and lower sides, respectively, for defining a space through which first fluid and second fluid flow, and at least one baffle disposed at the inside of the tank for separating the first fluid and the second fluid.

Also, the integral-type heat exchanger of the present invention further comprises supports, each of which is engaged between the first core portion and the second core portion.

Moreover, a heat interception slot is further formed at a boundary portion of the first fluid and second fluid of the tank for reducing the amount of heat transfer.

In addition, the first tube and the second tube are formed to have sizes different from each other.

Moreover, the first fluid of the upper first core portion is cooling water flowing through an engine of a vehicle, and the second fluid of the lower core portion is cooling water for cooling an inverter circuit of a driving motor.

Furthermore, the baffle is disposed to divide the inside of the header tank into first and second spaces A, B in the longitudinal direction.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will now be made in detail to the preferred embodiment of the present invention with reference to the attached drawings.

Figure 1:
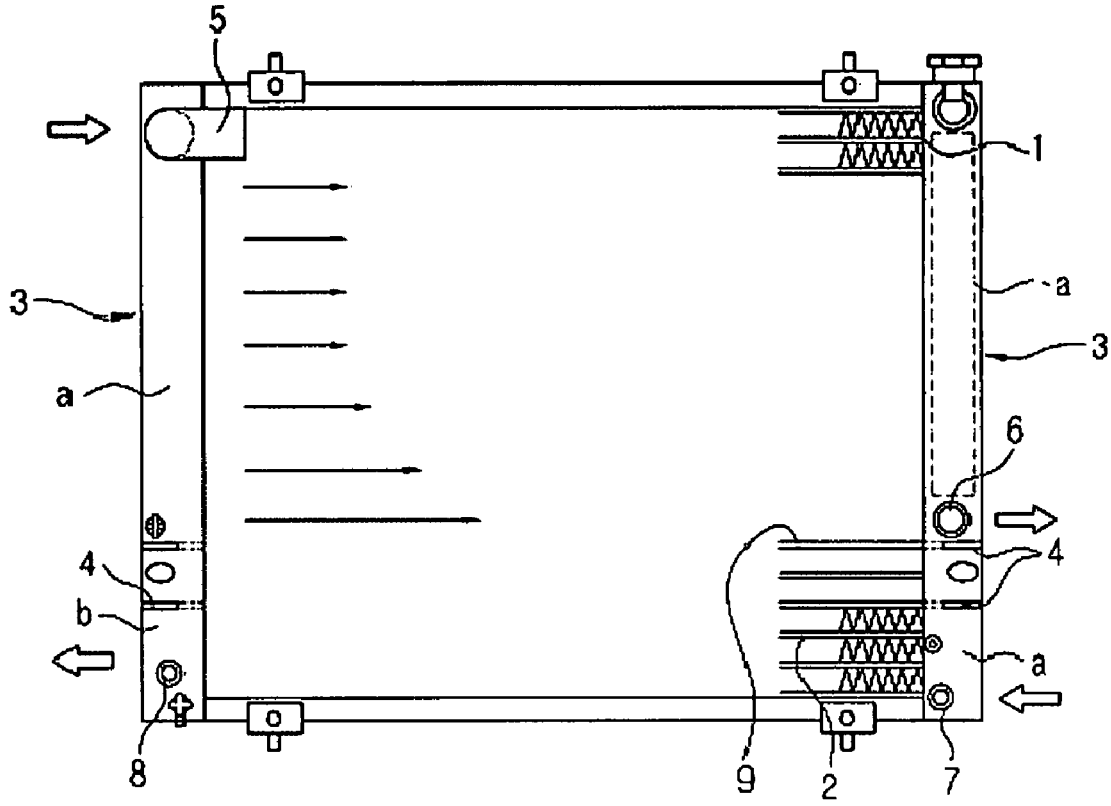
FIG. 1 is a view for showing an integral-type heat exchanger according to conventional art.
Figure 2:
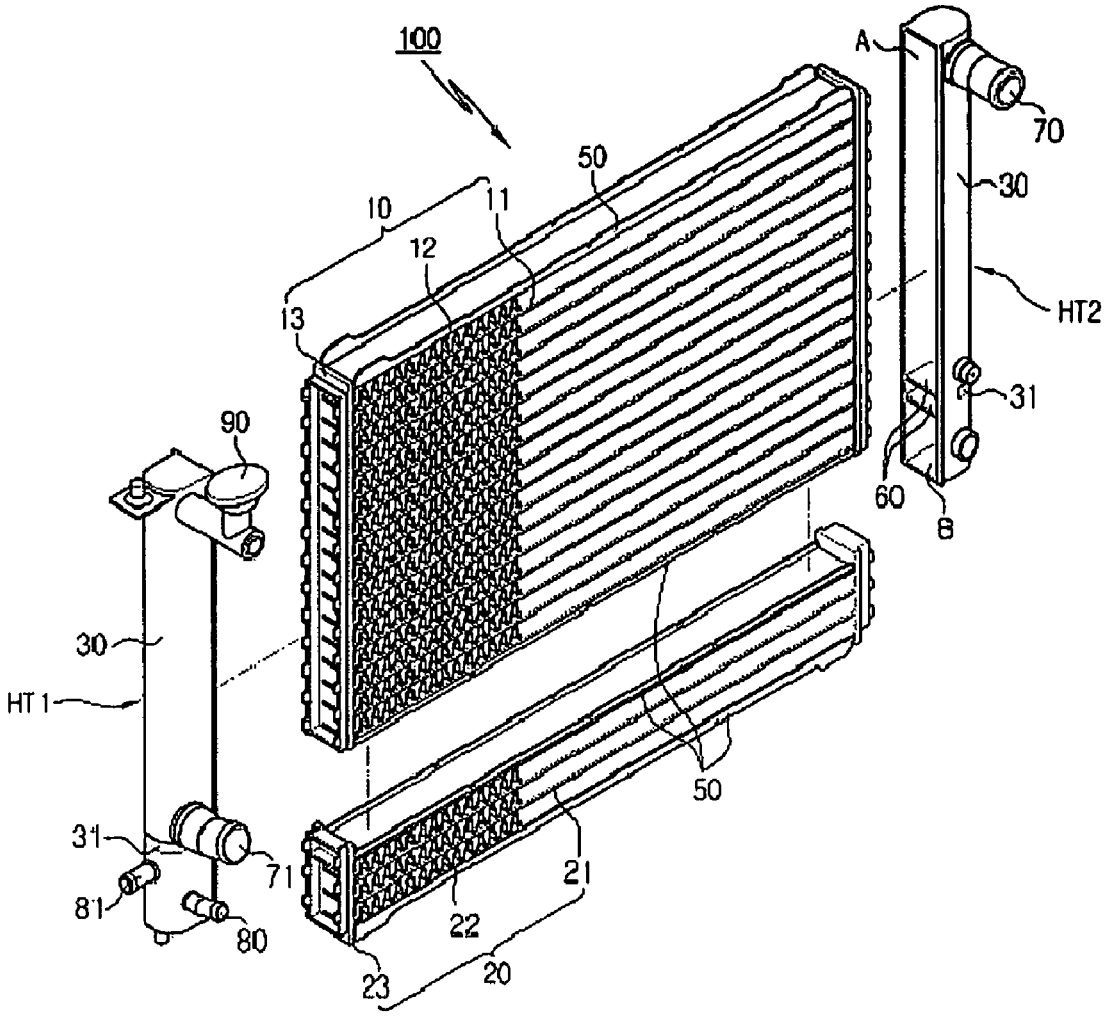
FIG. 2 is an exploded perspective view of an integral-type heat exchanger according to the present invention.
Figure 3:
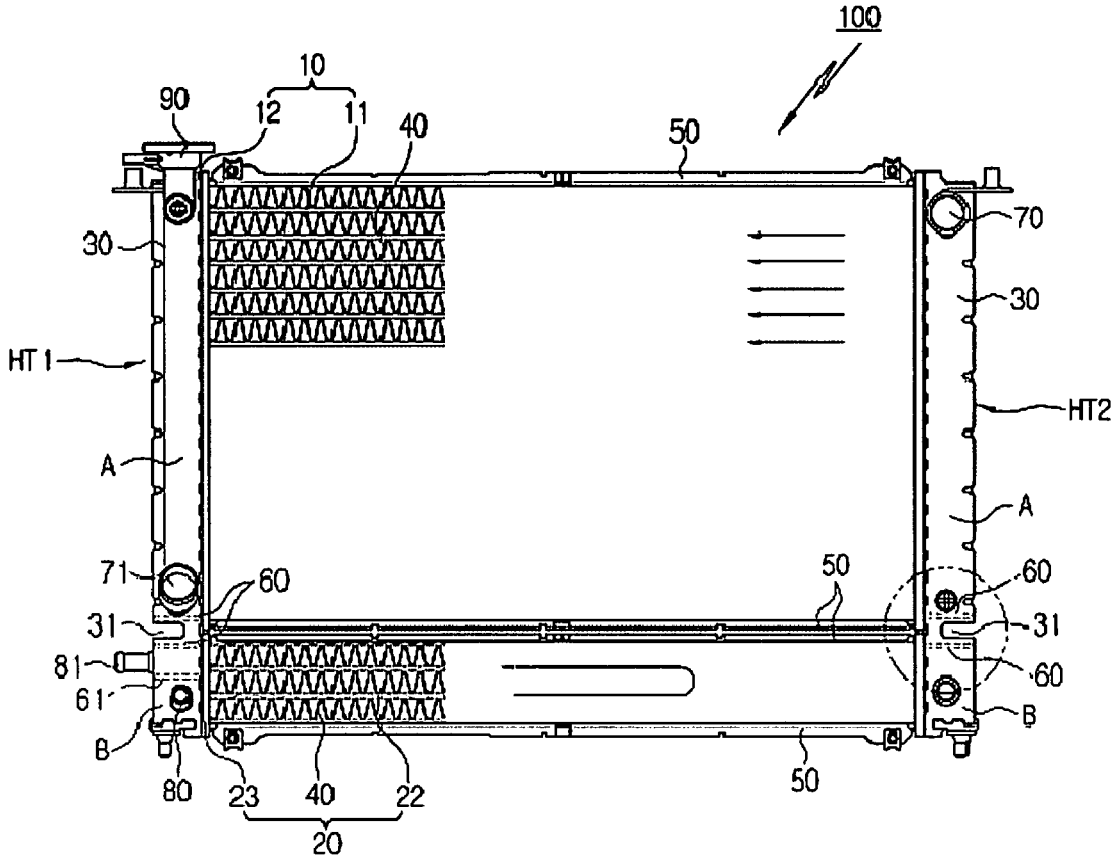
FIG. 3 is a front view of the integral-type heat exchanger according to the present invention.
Figure 4:
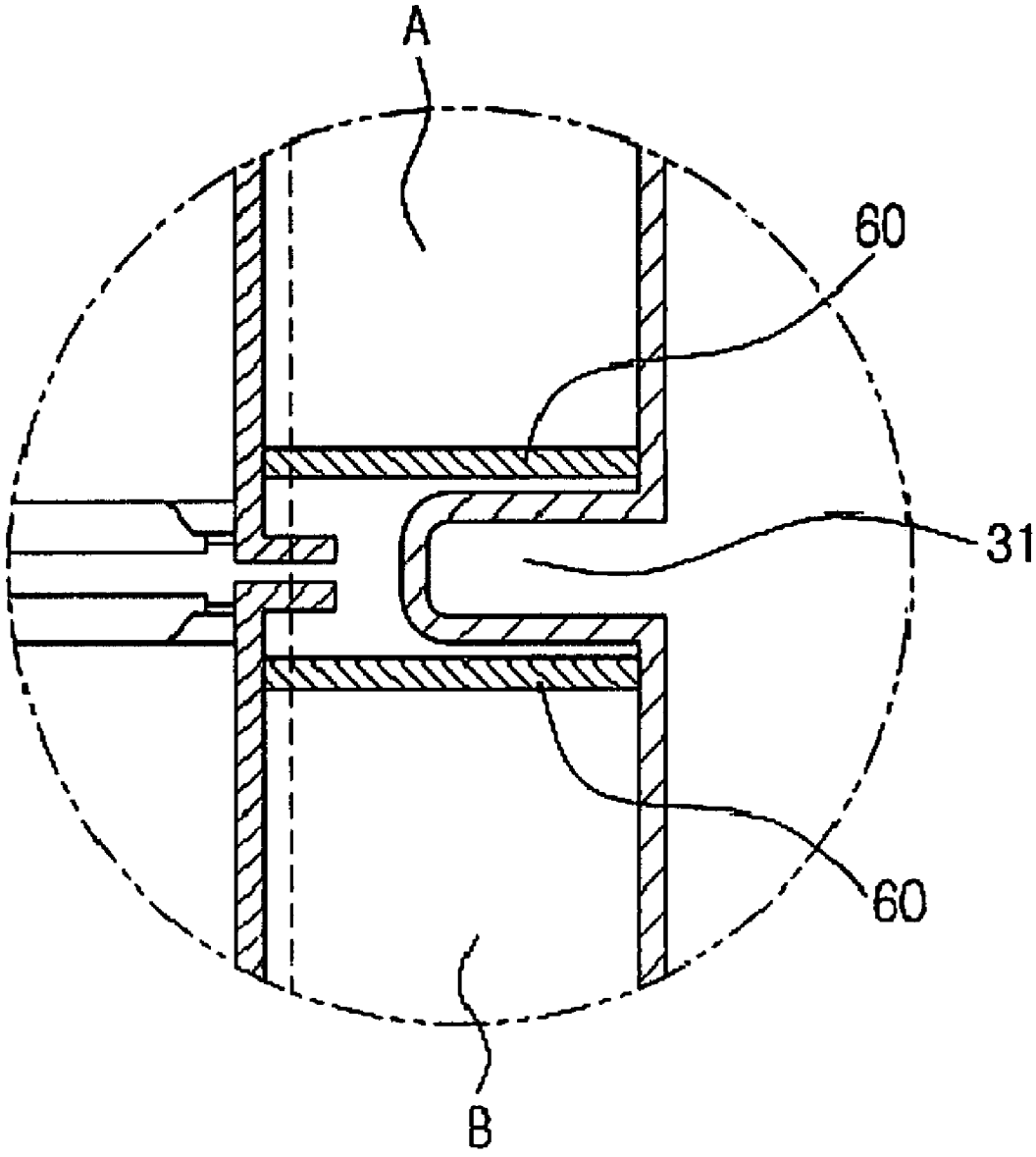
FIG. 4 is a partial cross-sectional view of a principal portion of the heat exchanger according to the present invention.

FIG. 2 is an exploded perspective view of an integral-type heat exchanger according to the present invention, FIG. 3 is a front view of the integral-type heat exchanger according to the present invention, and FIG. 4 is a partial cross-sectional view of a principal portion of the heat exchanger according to the present invention.

As shown in the drawing, the integral-type heat exchanger 100 of the present invention largely comprises a first core portion 10, a second core portion 20, and a tank 30.

The first core portion 10 includes a plurality of first tubes 11 through which first fluid flows, a first radiation fin 12 disposed between the first tubes 11, first headers 13, each of which is engaged with both ends of the first tubes 11.

The second core portion 20 includes a plurality of second tubes 21 through which second fluid flows, a second radiation fin 22 disposed between the second tubes 22, and second headers 23, each of which is engaged with both ends of the second tubes 21.

Also, the first tubes 11 and the second tubes 21 may be configured to have different sizes from each other according to the features of the fluid of the heat exchanger.

In addition, supports 50 are respectively engaged at upper and lower sides of the first and second core portions 10, 20, so that they can protect the first and second tubes 11, 21 and the radiation fins 12, 22. Especially, the support 50 disposed between the first and second core portions 10, 20 functions to intercept the heat transfer of the fluid flowing through the first and second core portions 10, 20.

The tank 30 is engaged with the first header 13 and the second header 23 of the first and second core portions 10, 20 in common, which are disposed at the upper and lower sides, respectively.

Also, a heat blocking slot 31 is formed at the boundary portion between the first fluid and the second fluid of the tank 30 so that it can reduce the amount of the heat transfer, and the heat blocking slot 31 is constructed to be open at the front and rear surfaces and at one side to thereby minimize the heat transfer amount to each other of the fluid flowing through the first and second core portions 10, 20.

Also, at least one baffle 60 is disposed at the inside of the tank 30 for separating the first fluid and second fluid.

In other words, the baffle 60 functions to divide the inside of the header tank into the first and second spaces A, B in the longitudinal direction, and it is preferable that two baffles 60 are disposed between the first and second spaces A, B to increase the effect of heat transfer in he present embodiment.

For reference, the first header 13 and the second header 23 disposed at one side tank 30 are called as first header tank HT1, and the first header 13 and the second header 23 disposed at the other side tank 30 are called as second header tank HT2.

Moreover, it has been shown that, first inlet and outlet pipes 70, 71 are disposed in the first space A, in such a construction as the first inlet pipe 70 is disposed in the second header tank HT2 and the first outlet pipe 71 is disposed in the first header tank HT1, and the fluid flows in an one-way manner.

In addition, it has been shown that, second inlet and outlet pipes 80, 81 are disposed in the second space B, in such a construction as the second inlet and outlet pipes 80, 81 are disposed in the first header tank HT1, and the fluid flows in a manner of U-turn flow by a baffle 61 for defining a fluid passage, which is interposed on the second space B of the first header tank HT1.

Meanwhile, the unexplained reference numeral 90 denotes a cap for supplying engine cooling water.

Hereinafter, the action of the present invention will be described in detail below.

The integral-type heat exchanger according to the present invention can be applied to the hybrid car, which uses the engine and the electric motor as driving source, and in which the radiator for cooling the heat generated from the engine and the heat exchanger for cooling the inverter circuit driving the motor are formed integrally.

However, the integral-type heat exchanger of the present invention is not restricted to it, and it should be known that it can be applied to any dual type heat exchanger for performing the heat exchange of two kinds of fluids.

In the present invention, the first core portion 10 through which the engine cooling water is flowed and the second core portion 20 through which the inverter cooling water is flowed are separately manufactured.

Also, the first core portion 10 and the second core portion 20 are constructed that the first and second header 13, 23 are respectively engaged with both ends of the first and second tubes 11, 21, the radiation fins 12, 22 are interposed between the first and second tubes 11, 21, and the supports 50 are disposed at the outermost portion.

It is possible to reinforce the strength by protecting the fins and the tubes by the supports 50 when the respective first core portion 10 and the second core portion 20 are transported to assemble them.

In other words, it is possible to maintain the positions of the fins and the tubes so that they are not distorted and transformed when the first core portion 10 and the second core portion 20, which are separately assembled by the supports 50, are transported to engage with the common tank.

Especially, it is possible to assure the brazing of the fins or tubes while the specification of them is different.

The first and second header tanks HT1, HT2 are formed by engaging the common tank 30 with the first and second header 12, 22 after disposing the first and second core portion 10, 20 at the upper and lower sides with engaging the first and second core portions 10, 20 as described above.

Then, if the engine cooling water come in through the first inlet pipe 70 of thee first header tank HT1 passes through the first tube 11 and becomes to be flowed out through the first outlet pipe 71 of the second header tank HT2, heat exchange is performed to each other between the radiation fins 12 interposed between the first tubes 11 and the outside air.

Moreover, the inverter cooling water come in through the second inlet pipe 80 disposed at the second space B of the first header tank HT1 passes through the second tube 21, and is flowed back by U-turn at the second space B of the second header tank HT2 to thereby be flowed out through the second outlet pipe 71 of the first header tank HT1, and heat exchange is performed to each other between the radiation fins 22 interposed between the second tubes 21 and the outside air.

In the present embodiment, the engine cooling water and the inverter cooling water of different temperature are flowed through the first and second core portions 10, 20, and the heat transfer is effectively intercepted by the support 50 disposed between the first and second core portions 10, 20 and the slot 31 disposed at the tank 30.

Meanwhile, if the operation conditions such as the temperature and pressure of the first and second fluids of the integral-type heat exchanger are different, the specification of the fins or the tubes of the first and second core portions 10, 20 through which respective fluids become to be different from each other.

In the present embodiment, since there is a productive problem that it is difficult to assemble the first core portion 10 and the second core portion 20 at one assembling establishment by using the fins and the tubes of different specifications, the first core portion 10 and the second core portion 20 are respectively engaged at separate assembling establishment, and relative position of the core portions are secured by the common tank so that the productivity can be improved.

When the first and second core portions 10, 20 are manufactured into one header tank, the amount of the heat transfer between the first core portion 10 and the second core portion 20 becomes to be large to reduce the capacity of the entire heat exchanger. However, the integral-type heat exchanger suppresses the heat exchange between the core portions to the maximum by using separate header, and improves the productivity and capacity of the heat exchanger by using the common header.

As described above, according to the integral-type heat exchanger of the present invention, the first and second core portions constructed of tubes/fins/headers are manufactured respectively into the integral-type heat exchanger by engaging with single tank to thereby increase the productivity and the effect of intercepting the heat transfer.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An integral-type heat exchanger including:

a first core portion including a plurality of first tubes through which first fluid flows, first radiation fins interposed between the first tubes, and first headers, each of which is engaged with both ends of the first tubes;

a second core portion including a plurality of second tubes through which second fluid flows, second radiation fins interposed between the second tubes, and second headers, each of which is engaged with both ends of the second tubes;

tanks, each of which is engaged concurrently with the first header of the first core portion and the second header of the second core portion disposed at the upper and lower sides, respectively, for defining a space through which first fluid and second fluid flow; and at least one baffle disposed at the inside of the tank for separating the first fluid and the second fluid, characterized in that the first core portion and the second header of the second core portion are independently manufactured as separate parts with supports respectively engaged at upper and lower sides of both the first and second core portions, and the manufactured first and second core portions are integrally coupled to the tanks, each tank formed as a single member extending from the upper part of the first core portion to the lower part of the second core portion.

2. The integral-type heat exchanger according to claim 1, further comprising a heat interception slot formed at a boundary portion of the first fluid and second fluid of the tank for reducing the amount of heat transfer.

3. The integral-type heat exchanger according to claim 1, wherein the first tube and the second tube are formed to have sizes different from each other.

4. The integral-type heat exchanger according to claim 1, wherein the first fluid of the upper first core portion is cooling water flowing through an engine of a vehicle, and the second fluid of the lower core portion is cooling water for cooling an inverter circuit of a driving motor.

5. The integral-type heat exchanger according to claim 1, wherein the baffle is disposed to divide the inside of the header tank into first and second spaces A, B in the longitudinal direction.

* * * * *